US011060296B2

(12) United States Patent
Castel

(10) Patent No.: US 11,060,296 B2
(45) Date of Patent: Jul. 13, 2021

(54) MODULAR MULTIFUNCTION SHADING DEVICE, PARTICULARLY FOR A PERGOLA

(71) Applicant: Jean-Louis Castel, Poitiers (FR)

(72) Inventor: Jean-Louis Castel, Poitiers (FR)

( * ) Notice: Subject to any disclaimer, the term of this patent is extended or adjusted under 35 U.S.C. 154(b) by 340 days.

(21) Appl. No.: 15/568,845

(22) PCT Filed: Apr. 21, 2016

(86) PCT No.: PCT/FR2016/050933

§ 371 (c)(1),
(2) Date: Oct. 24, 2017

(87) PCT Pub. No.: WO2017/001735

PCT Pub. Date: Jan. 5, 2017

(65) Prior Publication Data

US 2018/0106046 A1 Apr. 19, 2018

(30) Foreign Application Priority Data

Apr. 24, 2015 (FR) ..... 1553713

(51) Int. Cl.

| | |
|---|---|
| ***E06B 9/40*** | (2006.01) |
| ***E04F 10/00*** | (2006.01) |
| ***E04F 10/06*** | (2006.01) |
| ***E04F 10/02*** | (2006.01) |
| ***E04F 10/10*** | (2006.01) |

(52) U.S. Cl.

CPC ..... *E04F 10/0607* (2013.01); *E04F 10/02* (2013.01); *E04F 10/0648* (2013.01); *E04F 10/10* (2013.01); *E06B 9/40* (2013.01)

(58) Field of Classification Search

CPC ... E04F 10/0607; E04F 10/02; E04F 10/0655; E04F 10/0648; E06B 9/40; E06B 2009/405; E06B 2009/2452; E06B 2009/2458; A45B 2023/0093; A45B 2009/2447

See application file for complete search history.

(56) References Cited

U.S. PATENT DOCUMENTS 2,336,692 A * 12/1943 Lubetsky ..... A47H 23/06 160/120
6,070,639 A * 6/2000 Winston ..... E06B 9/40 160/120
6,571,851 B1 * 6/2003 Jelic ..... E06B 9/262 160/107

(Continued)

FOREIGN PATENT DOCUMENTS

| | | |
|---|---|---|
| EP | 2817463 | 12/2014 |
| FR | 2676079 | 11/1992 |

(Continued)

OTHER PUBLICATIONS

International Search Report, dated Jul. 22, 2016, priority document.

*Primary Examiner* — Daniel P Cahn
(74) *Attorney, Agent, or Firm* — Greer, Burns & Crain, Ltd.

(57) ABSTRACT

A multifunction shading device for creating a pergola. The device includes a structure that provides support for the device. The device also includes modules, each module equipped with a blind and a mechanism configured to control a length of the blind distributed along one axis of the structure.

6 Claims, 3 Drawing Sheets

(56) References Cited

U.S. PATENT DOCUMENTS 9,422,715 B1 * 8/2016 Selzer ..... E04F 10/08
9,528,313 B1 * 12/2016 Arimilli ..... E04F 10/02
10,280,625 B2 * 5/2019 Byszenski ..... E05F 15/619
10,422,152 B2 * 9/2019 Dresch ..... E04H 15/14
2004/0261953 A1 * 12/2004 Hart ..... E04B 7/14 160/80
2005/0241779 A1 * 11/2005 Abouloukme ..... E06B 9/64 160/122
2006/0090858 A1 * 5/2006 Heidenreich ..... E04F 10/0655 160/68
2008/0067278 A1 3/2008 Fortunato et al.
2008/0142064 A1 * 6/2008 Maraki ..... E04F 10/02 135/121
2009/0277593 A1 * 11/2009 Stewart ..... E06B 9/40 160/127
2011/0061821 A1 * 3/2011 Kim ..... E06B 9/264 160/305
2012/0125546 A1 * 5/2012 Cooper ..... A62C 2/10 160/241
2013/0068401 A1 * 3/2013 Birkestrand ..... E06B 9/364 160/133
2013/0098563 A1 * 4/2013 Jang ..... E06B 9/42 160/120
2014/0262075 A1 * 9/2014 Clarren ..... E06B 9/24 160/237
2016/0177575 A1 * 6/2016 Ivic ..... E04F 10/10 52/302.1
2016/0290044 A1 * 10/2016 Somech ..... E06B 9/171
2017/0016245 A1 * 1/2017 Bailey ..... E06B 9/58
2018/0023338 A1 * 1/2018 Werner ..... E06B 9/01 160/167 R
2019/0112832 A1 * 4/2019 Larin ..... E04H 15/18
2019/0242136 A1 * 8/2019 Shargani ..... E04B 1/34357

FOREIGN PATENT DOCUMENTS

WO 2006042377 4/2006
WO 2009137328 11/2009

* cited by examiner

MODULAR MULTIFUNCTION SHADING DEVICE, PARTICULARLY FOR A PERGOLA

CROSS-REFERENCES TO RELATED APPLICATIONS

This application claims the benefit of the French patent application No. 1553713 filed on Apr. 24, 2015, the entire disclosures of which are incorporated herein by way of reference.

BACKGROUND OF THE INVENTION

This invention relates to a modular multifunction shading device, particularly for a pergola, to control the quality, extent and nature of the shading.

Pergola devices are known that allow the shading to be adjusted depending on requirements and depending on meteorological conditions.

Patent application FR 2 676 079 describes an arrangement with swiveling blades that ensure total shading when they are in a horizontal position, an interruption of the sunrays when the blades are perpendicular to the sunrays and offer minimal shading when the blades are parallel to the sunrays. According to an enhancement, the blades also comprise edge profiles that cooperate with each other to ensure a seal when the blades are in a horizontal plane.

Indeed, the cover provided by these blades ensures protection against rain.

Another patent application, EP 2 817 463, describes a pergola comprising panels that are movable in translation, with superimposed edges. These panels allow the shading to be controlled by moving and superimposing or de-superimposing the panels along horizontal axes X and Y.

This arrangement allows the nature and surface area of the shading, as well as the position of the shaded area, to be easily modified.

The nature of the panels can also be modified, either they are totally rigid panels or they are stretched panels of fabric/canvas or even meshed fabric, producing a sunscreen effect, stretched within a frame.

The pergolas according to these patent applications provide total satisfaction.

SUMMARY OF THE INVENTION

This invention falls precisely within the same context as a sunscreen, providing variable shading of a surface and offering a multifunction device with the aid of one control unit.

BRIEF DESCRIPTION OF THE DRAWINGS

This device will now be described in detail with regard to the accompanying drawings, in which the various Figures show.

DETAILED DESCRIPTION OF THE PREFERRED EMBODIMENTS

Figure 1:
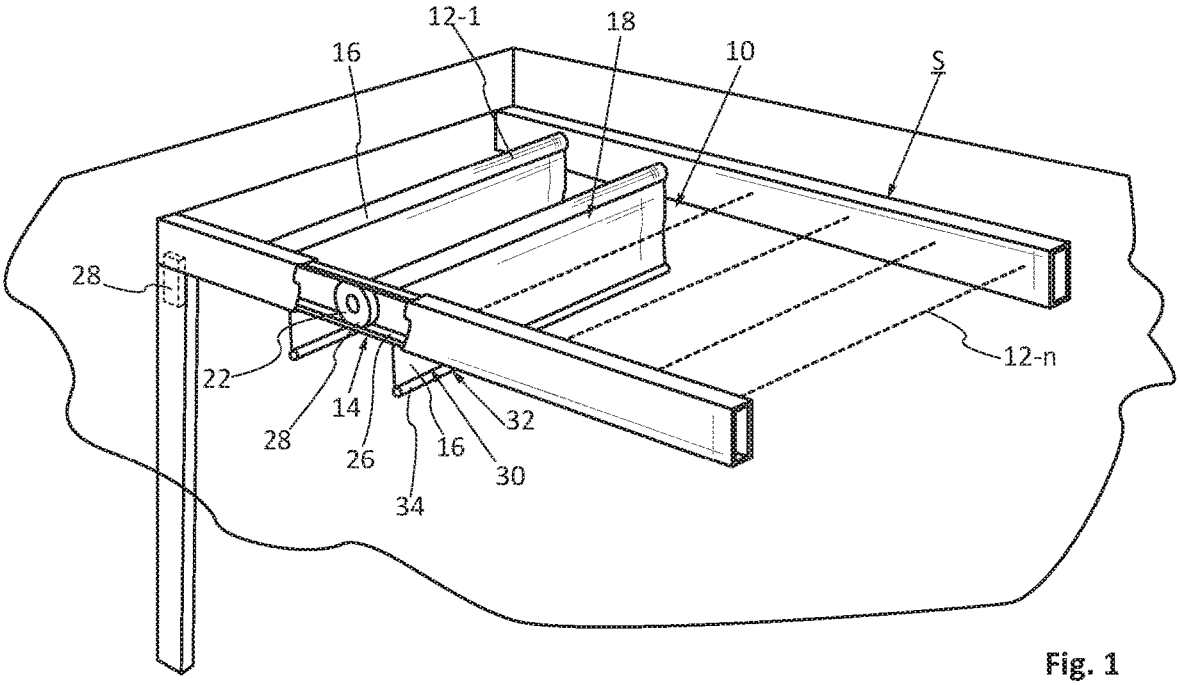
FIG. 1: a schematic view of a modular multifunction shading device according to the present invention.
Figure 2:
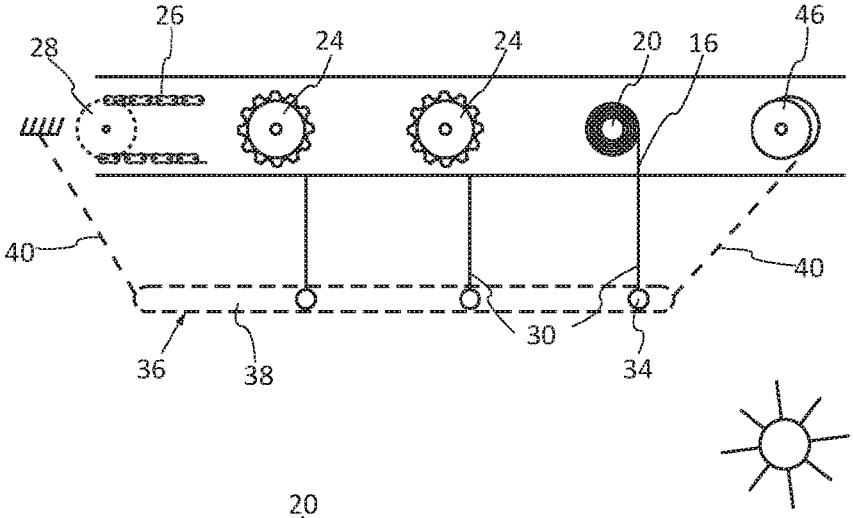
FIG. 2: a schematic side elevation view of FIG. 1, FIG. 3A: a view in the light shading position.

The shading device 10 according to the present invention as shown in FIG. 1 comprises a structure S that provides support for the device, the structure comprising in a known way at least two parallel beams and usually a frame and possibly two posts supporting the beams or frame when the beams or frame are isolated and therefore incapable of being connected to walls, for example.

The frame is in a horizontal position and the posts are vertical.

This structure comprises at least two longitudinal, horizontal beams, to which the shading device 10 according to the present invention is fixed.

This device 10 comprises modules 12-1, **12-*n*, distributed along one axis of the structure, in particular the longitudinal, horizontal axis, and means 14** for maneuvering these modules.

In the embodiment shown, each module 12-1, **12-*n* is equipped with a blind 16-1, 16-*n* and means 18 to control the length of the blind. In a preferred embodiment, the means 18 to control the length of each blind 16 comprise, for each module, a roller 20 arranged transversely onto which is fixed one end of the blind and means 22** of driving each roller in rotation, in one direction of rotation and in the other direction of rotation, thus causing the screen to be wound up or down.

In a preferred embodiment, the means 22 for driving each roller 20 comprise a pinion 24 integral with the roller and cooperating with a single chain 26 common to the pinions of the various rollers, itself rotated by a motor 28 provided with a driving pinion of the chain.

Thus, the motor 28, by turning the chain in one direction or the other, rotates each of the shafts synchronously and causes each blind either to be wound up or down.

The pinion/chain assemblies can be replaced by toothed belts 48 and toothed pulleys 50, as shown in FIG. 5, which includes a driving pulley **50*a* driven by the motor 28**, without in any way modifying the present invention.

The operation of this arrangement leads to the shading being controlled. In fact, when the device is activated so as to totally wind up the blinds, only the shadow relating to the presence of the rollers that intercept the sunrays exists. This situation also arises when the sun is at its zenith.

Figure 3A:
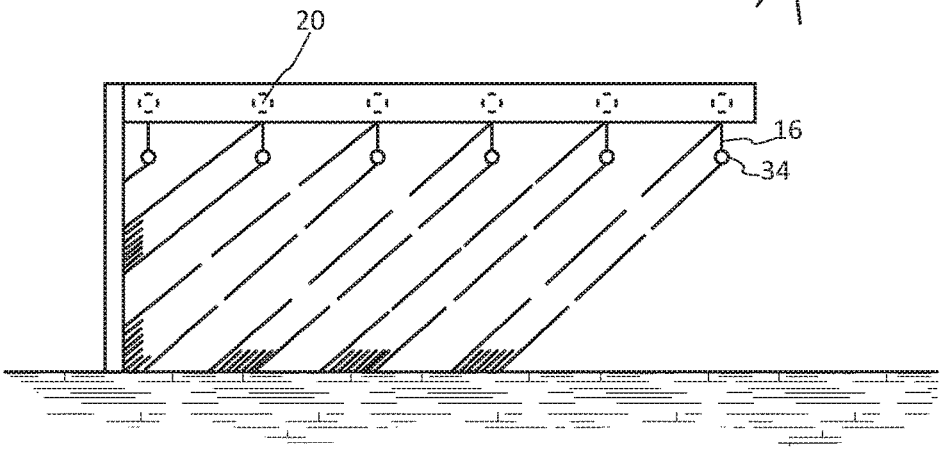
FIG. 3B: a view in the heavy shading position.
FIG. 3C: a view in the sunscreen roof position.
FIG. 3D: an alternative view in the sunscreen roof position.
Figure 3B:
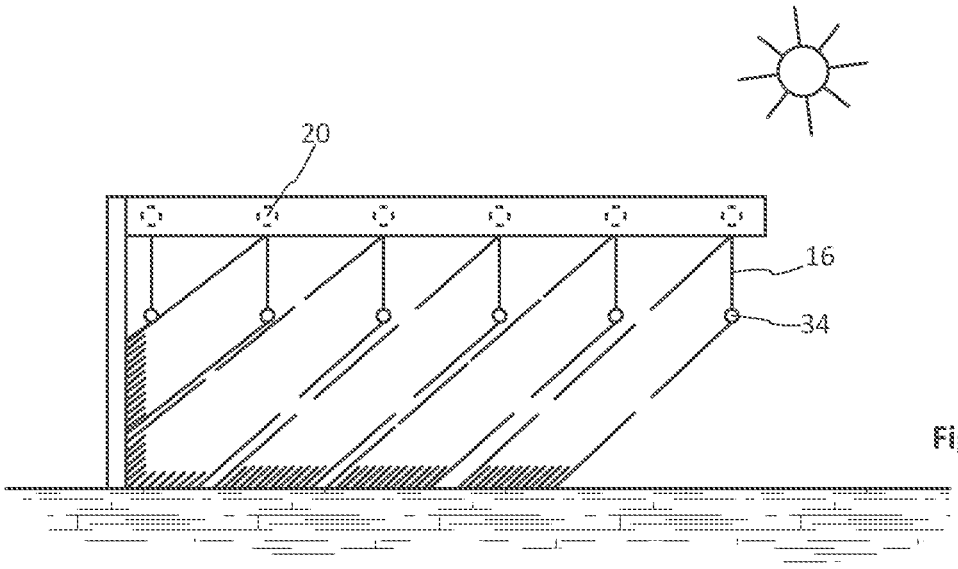

When the sun is in a position other than its zenith position, the rays are inclined and, in fact, the blinds can be lowered so as to provide more or less shade against the rays by generating a more or less extensive drop shadow. See FIGS. 3A and 3B.

Preferably, each blind comprises at its base 30, in the bottom part, weighting means 32 so as to keep the blinds substantially vertical.

Advantageously, the weighting means 32 comprises a rigid rod 34.

According to an enhancement of the invention, the device also comprises means 36 to maneuver the bases 30 of the blinds 12.

These maneuvering means 36 can take the form of at least one bar 38, preferably rigid, connecting the various bases 30, perpendicularly, and, in particular, at the ends of these bases. This at least one bar 38 can be arranged laterally and, in this case, two bars are provided.

Each bar 38 is itself supported and connected by each of its ends to a traction link 40.

This traction link 40 lifts each bar 38 by its two ends 42-1, **42-*n*. The traction point is located substantially in the plane of the rollers 20. For this purpose, traction means 44 comprise a motorized drum 46 designed to wind up one end of the traction link 40**, that is, a closed-loop link, the other end remaining fixed.

When the drum turns in one direction, it winds up one end of the link and in the opposite direction, it winds this end down. Thus, the reduction in length of the traction link 40 causes the bar 38 to be raised by both ends, as well as causing a translational movement.

The traction link 40 allows the bases 30 of the blinds 12 to be raised, and to incline them, and even place them in a horizontal position. To this end, the traction point of the link 40 to both ends is located substantially in the plane of the rollers 20. In fact, return pulleys can be provided, in a known way.

Figure 3C:
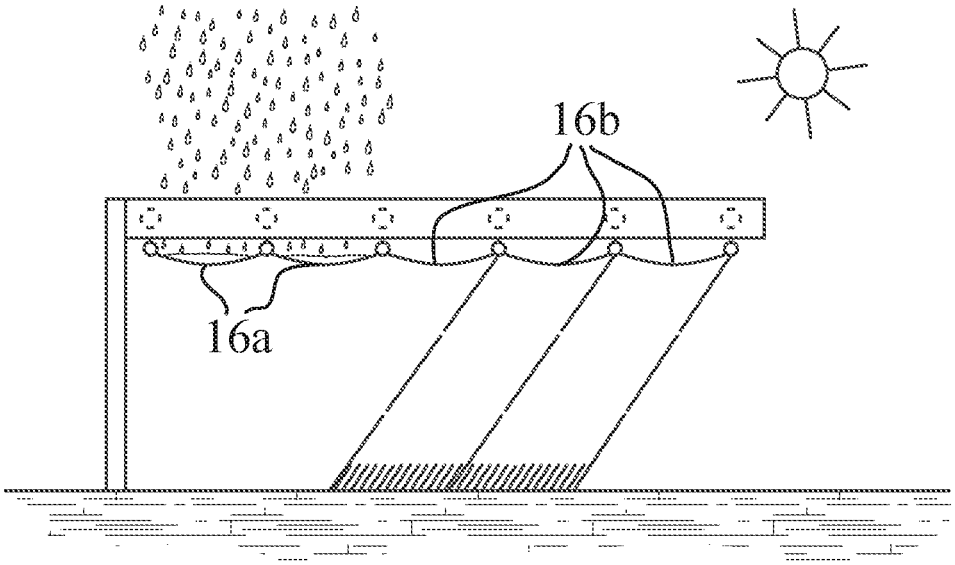

The length of the blind 12 of a roller can advantageously be adjusted so that, when the rigid bar 38 is brought level with the plane of the rollers, the base 30 is perpendicular to the roller that is juxtaposed to the roller carrying the blind. There is, thus, continuity of the shading surface that then forms a sunscreen roof. See FIG. 3C.

Figure 3D:
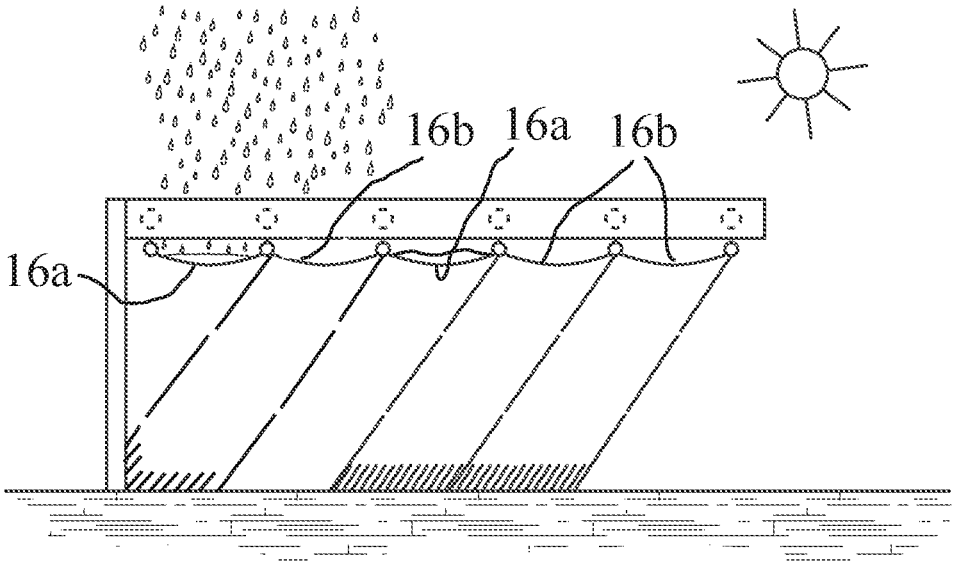

It will also be understood that the blinds 16 can be made of different materials, either of coated impermeable waterproof fabric 16*a* or of permeable sunscreen woven canvas 16*b* or even an alternation of these types of blinds. See FIGS. 3C and 3D.

The colors can be combined to achieve certain architectural effects.

Such a device has the advantage conferring upon the pergola assembly using this multifunction shading device an advantageous architectural sophistication due to the fact of a certain mobility of the blinds under the effects of the wind, the possibility of adjusting the exposed blind surface and the possibility of adjusting the inclination of the blinds.

Another advantage is the total elimination of the wind factor once the blinds are wound up because then only the structure is involved but then there is no problem with wind resistance.

Figure 4:
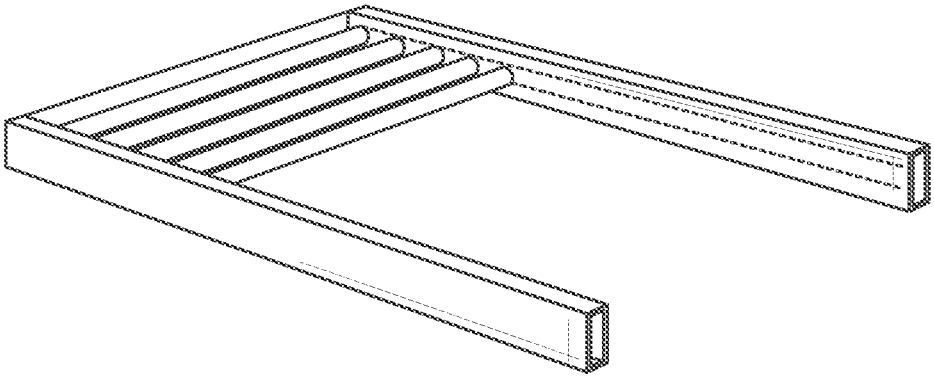
FIG. 4: a view of an enhancement with module retraction means.

The device according to the present invention can also be of interest as a variation enabling the rollers to be translated in order to group them next to each other, in juxtaposition. See FIG. 4.

In this case, means to disengage the toothed belt/pulley or pinion/chain assemblies and a hinged connecting bar should be provided so that the latter can fold up between each base.

Another variation also involves, depending on the orientation for example, providing winders that are alternated with lowered blinds and other raised blinds and vice versa. This simply involves reversing the winding direction. It is then possible to lower blinds of one color and raise blinds of another color, as desired, depending on luminosity for example. The alternation can be regular or irregular.

Moreover, different lengths with proportional winding speeds can be provided. Thus, long blinds are wound up faster than short blinds so that all of the blinds are wound up at the end of travel but have different lengths when they are lowered, particularly when they are in the lowest position.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A multifunction shading device, comprising:
- a horizontal support structure,
- a plurality of modules, each module secured to the horizontal structure and equipped with
  - a blind and
  - a control apparatus configured to control a length of the blind, the control apparatus comprising
    - a roller fixed to an end of the blind and
    - a mechanism configured to drive the roller in rotation, in a first direction of rotation and in a second direction of rotation, thus causing a screen formed by said blinds to be alternately wound up or down,
- the modules arranged along a horizontal axis of the horizontal structure,
  - wherein each blind comprises a base, in a bottom part, connected to a maneuvering device comprising at least one bar connecting the bases, perpendicularly to a major length of the bases, the at least one bar being supported and connected at ends thereof to a traction link, and
- wherein the multifunction shading device further comprises a motorized drum to raise and move the at least one bar in horizontal translation.

2. The multifunction shading device according to claim 1, wherein each roller comprises a pinion integral with each roller respectively and cooperating with a single chain common to the pinions of the rollers, the single chain configured to be rotated by a motor provided with a driving pinion for the single chain.

3. The multifunction shading device according to claim 1, wherein each roller comprises a toothed pulley integral with each roller respectively and cooperating with a single toothed belt common to the pulleys, the single toothed belt configured to be rotated by a motor provided with a driving pulley for the single toothed belt.

4. The multifunction shading device according to claim 1, wherein the blinds are made from a material selected from the group consisting of:
- coated impermeable waterproof fabric,
- permeable sunscreen woven canvas,
- and an alternation thereof.

5. The multifunction shading device according to claim 1, wherein adjacent blinds are configured to wind in opposite directions.

6. The multifunction shading device according to claim 1, wherein a first blind is configured to wind at a different speed compared to a second blind, and wherein a length of one of the blinds is different from a length of another of the blinds.

* * * * *